US011705088B2

(12) United States Patent
Furihata et al.

(10) Patent No.: US 11,705,088 B2
(45) Date of Patent: Jul. 18, 2023

(54) DEVICE AND METHOD FOR BRIGHTNESS CONTROL OF DISPLAY DEVICE

(71) Applicant: SYNAPTICS INCORPORATED, San Jose, CA (US)

(72) Inventors: Hirobumi Furihata, Tokyo (JP); Takashi Nose, Tokyo (JP); Masao Orio, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 541 days.

(21) Appl. No.: 16/746,756

(22) Filed: Jan. 17, 2020

(65) Prior Publication Data

US 2021/0225323 A1 Jul. 22, 2021

(51) Int. Cl.
*G09G 5/10* (2006.01)

(52) U.S. Cl.
CPC ..... *G09G 5/10* (2013.01); *G09G 2320/0646* (2013.01)

(58) Field of Classification Search
CPC ..... G09G 5/10; G09G 2320/0646; G09G 2320/0673; G09G 2300/0814; G09G 2360/16; G09G 3/3233; G09G 3/20; G09G 3/32; G09G 3/3648; G09G 3/3225; G09G 2320/0233
See application file for complete search history.

(56) References Cited

U.S. PATENT DOCUMENTS

| | | | | |
|---|---|---|---|---|
| 8,970,642 | B2 * | 3/2015 | An | G09G 5/10 345/82 |
| 2013/0127923 | A1 * | 5/2013 | An | G09G 3/3233 345/690 |
| 2013/0135272 | A1 * | 5/2013 | Park | G09G 3/006 345/211 |
| 2014/0225943 | A1 * | 8/2014 | Shiobara | G09G 3/3413 345/694 |
| 2014/0300592 | A1 * | 10/2014 | Lee | G09G 3/3233 345/82 |
| 2017/0140733 | A1 * | 5/2017 | Park | G09G 5/10 |
| 2020/0135101 | A1 * | 4/2020 | Yamaguchi | G09G 3/3233 |

* cited by examiner

*Primary Examiner* — Lunyi Lao
*Assistant Examiner* — Jarurat Suteerawongsa
(74) *Attorney, Agent, or Firm* — Ferguson Braswell Fraser Kubasta PC

(57) ABSTRACT

A display driver comprises signal supply circuitry and control circuitry. The signal supply circuitry is configured to supply an emission control signal to a display panel. The emission control signal controls a ratio of pixel circuits that emit light to pixels of the display panel. The control circuitry is configured to control the emission control signal based on an input image data.

19 Claims, 13 Drawing Sheets
(4 of 13 Drawing Sheet(s) Filed in Color)

DEVICE AND METHOD FOR BRIGHTNESS CONTROL OF DISPLAY DEVICE

BACKGROUND

Field

Embodiments disclosed herein generally relate to a device and method for brightness control of a display device.

Description of the Related Art

The quality of a display image may depend on a dynamic brightness range of the display device. To improve the image quality, the brightness control of a display device may be utilized to increase the dynamic brightness range.

SUMMARY

This Summary is provided to introduce in a simplified form a selection of concepts that are further described below in the Detailed Description. This Summary is not intended to identify key features or essential features of the claimed subject matter, nor is it intended to limit the scope of the claimed subject matter.

In one or more embodiments, a display driver is disclosed. The display driver comprises signal supply circuitry and control circuitry. The signal supply circuitry is configured to supply an emission control signal to a display panel. The emission control signal controls a ratio of pixel circuits that emit light to pixels of the display panel. The control circuitry is configured to control the emission control signal based on an input image data.

In one or more embodiments, a display device is disclosed. The display device comprises a display panel and a display driver. The display driver comprises signal supply circuitry and control circuitry. The signal supply circuitry is configured to supply an emission control signal to a display panel. The emission control signal controls a ratio of pixel circuits that emit light to pixels of the display panel. The control circuitry is configured to control the emission control signal based on an input image data.

In one or more embodiments, a method is also disclosed. The method comprises supplying to a display panel an emission control signal to control a ratio of pixel circuits that emit light to pixels of the display panel and controlling the emission control signal based on an input image data.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
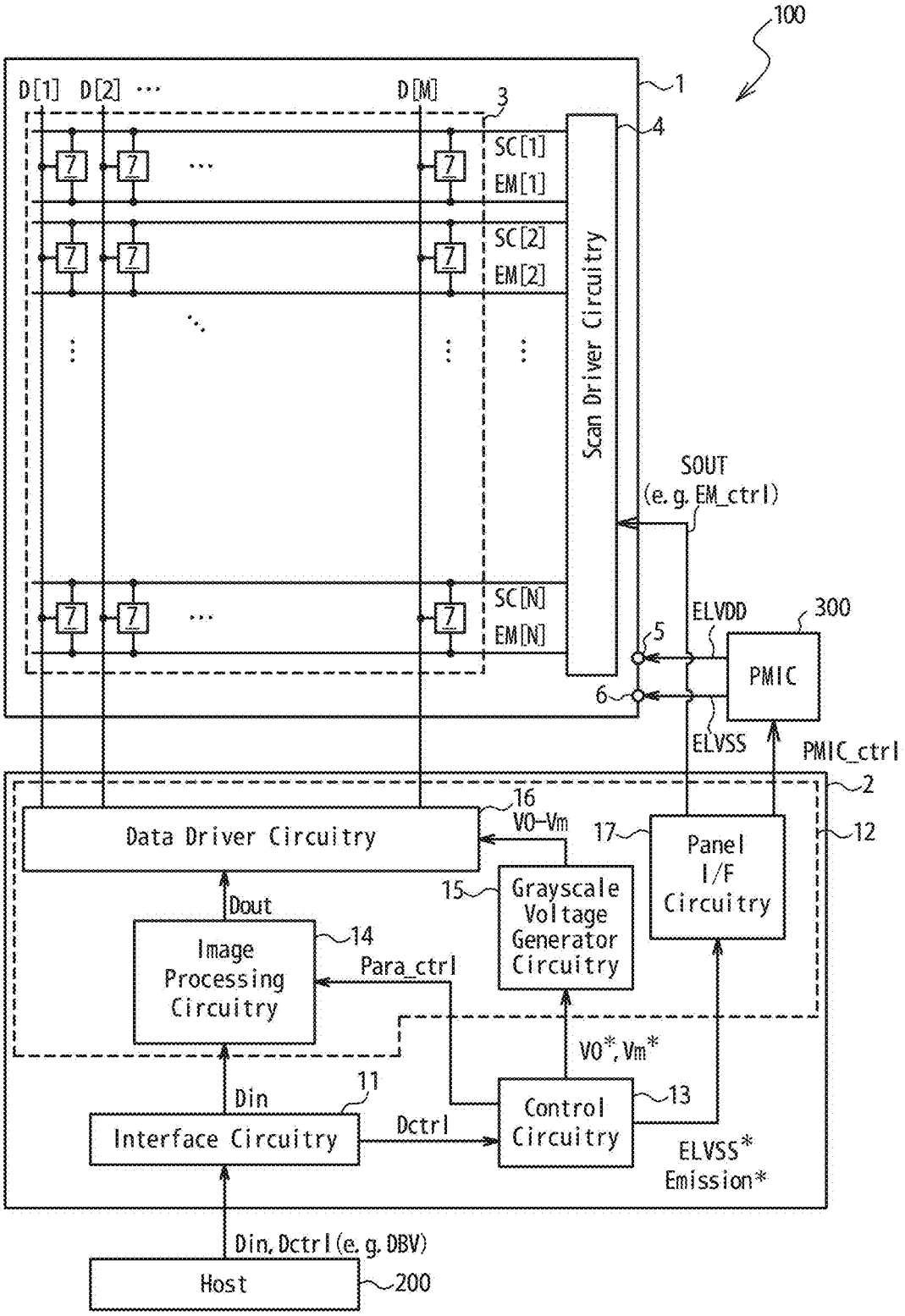
FIG. 1 illustrates an example configuration of a display device, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

A display image may include a region in which the brightness is locally high. In such cases, the image quality may depend on the brightness dynamic range of the display device. An increased brightness dynamic range may enable displaying a bright portion of the display image with increased brightness and a dark portion with reduced brightness.

In one or more embodiments, signal supply circuitry configured to supply at least one signal to a display panel is adaptively controlled based on an input image data to increase the brightness dynamic range. In various embodiments, the signal supply circuitry may be configured to generate an emission control signal that controls a ratio of pixels that emit light to the total number of pixels disposed in a display panel. In such embodiments, the emission control signal may be adaptively controlled based on the input image data. In one or more embodiments, the signal supply circuitry may be controlled to increase the brightness of the entire display image based on the input image data, when the image corresponding to the input image data contains a bright portion. In such embodiments, image processing circuitry of the signal supply circuitry may be configured to perform image processing to cancel the increase in the brightness for pixels in a dark portion in the display image. This may effectively increase the contrast of the display image.

FIG. 1 illustrates an example configuration of a display device 100, according to one or more embodiments. The display device 100 may be configured to display an image corresponding to an input image data Din received from a host 200. Examples of the host 200 may include an application processor, a central processing unit (CPU) or other processors. The display device 100 comprises a display panel 1 and a display driver 2. The display panel 1 may comprise a self-luminous display panel, such as an organic light emitting diode (OLED) display panel. In other embodiments, the display panel 1 may be a liquid crystal display panel. In the embodiment shown, the display panel 1 comprises a display area 3, scan driver circuitry 4, a high-side power source terminal 5, and a low-side power source terminal 6. Display area 3 includes pixel circuits 7, N scan lines SC [1] to SC [N], N emission lines EM [1] to EM [N], and M data lines D [1] to D [M] are disposed in the display area 3. The scan lines SC [1] to SC [N] and the N emission lines EM [1] to EM [N] are coupled to the scan driver circuitry 4 and the data lines D [1] to D [M] are coupled to the display driver 2. The scan lines SC [1] to SC [N] and the emission lines EM [1] to EM [N] are extended in the horizontal direction of the display panel 1, and the data lines D [1] to D [M] are extended in the vertical direction. Each pixel circuit 7 is coupled to a corresponding scan line SC, emission line EM, and data line D.

In various embodiments, the high-side power source terminal 5 and the low-side power source terminals 6 are configured to receive a high-side power source voltage ELVDD and a low-side power source voltage ELVSS from a power management integrated circuit (PMIC) 300, respectively. The high-side power source voltage ELVDD may be delivered to the respective pixel circuits 7 from the high-side power source terminal 5 via high-side power source lines (not illustrated), the low-side power source voltage ELVSS may be delivered to the respective pixel circuits 7 from the low-side power source terminal 6 via low-side power source lines (not illustrated).

Figure 2:
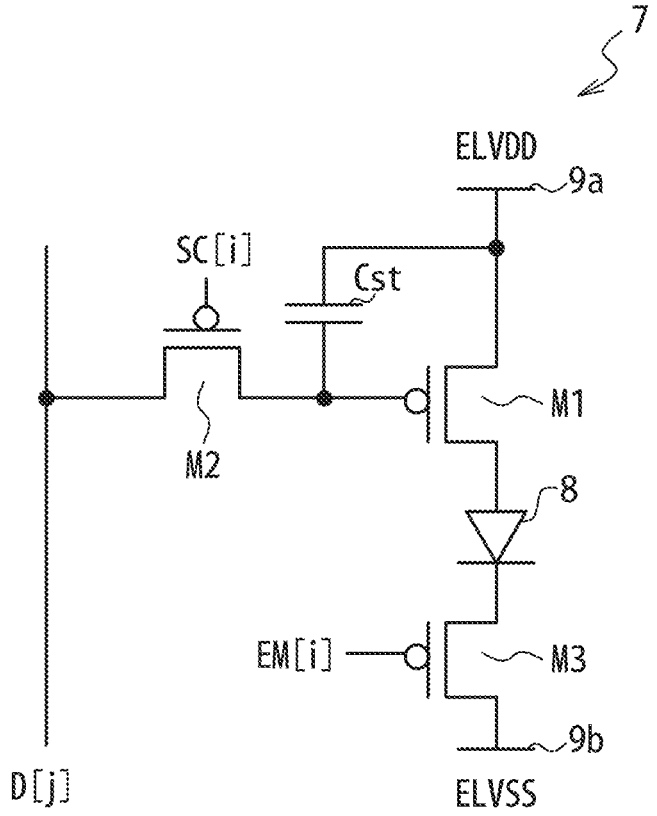
FIG. 2 illustrates an example configuration of a pixel circuit, according to one or more embodiments.

Pixel circuit 7 may be configured to emit light with a luminance level corresponding to a drive voltage received from the display driver 2. FIG. 2 illustrates an example configuration of pixel circuit 7. The pixel circuit 7 as shown comprises PMOS transistors M1 to M3, a storage capacitor Cst, and a light emitting element 8. The PMOS transistor M2 has a gate connected to the scan line SC[i] and is connected between the data line D[j] and the gate of the PMOS transistor M1. The PMOS transistor M1 has a source connected to a high-side power source node 9*a* configured to supply the high-side power source voltage ELVDD and a drain connected to a low-side power source node 9*b* configured to supply the low-side power source voltage ELVSS via the light emitting element 8 and the PMOS transistor M3. The light emitting element 8 may be an LED, OLED, or other light emitting elements suitable for the type of display panel 1. The PMOS transistor M3 has a gate connected to the emission line EM [i]. The storage capacitor Cst is connected between the gate and source of the PMOS transistor M1. The pixel circuits 7 may be configured differently than that illustrated in FIG. 2. For example, the pixel circuit 7 may be configured as a 5T2C circuit (consisting of five thin film transistors (TFTs)) or a 6T1C circuit (consisting of six TFTs and one capacitor).

In one or more embodiments, a write operation to program a drive voltage into a pixel circuit 7 may comprise asserting the scan line SC [i] in a state in which the emission line EM [i] is deasserted and the drive voltage is supplied to the data line D [j]. This operation achieves writing the drive voltage into the storage capacitor Cst. The storage capacitor Cst may be configured to hold a storage voltage corresponding to the drive voltage written thereinto.

In one or more embodiments, when the emission line EM [i] is deasserted, the light emitting element 8 is disconnected from the high-side power source node 9*a*, not emitting light. In one or more embodiments, when the emission line EM [i] is asserted, the light emitting element 8 emits light with a luminance level corresponding to the storage voltage across the storage capacitor Cst.

In one or more embodiments, such as the embodiment illustrated in FIG. 2, the voltage between the high-side power source node 9*a* and the gate of the PMOS transistor M1 increases as the drive voltage written into the pixel circuit 7 decreases, and the increase in voltage between the high-side power source node 9*a* and the gate of the PMOS transistor M1 increases the luminance level of the pixel circuit 7. In such embodiments, the low-side power supply voltage ELVSS is set to be lower than the allowed lowest drive voltage.

Figure 3:
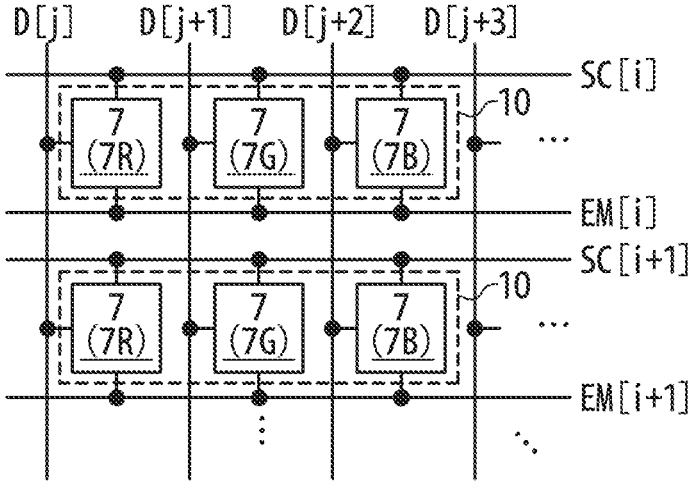
FIG. 3 illustrates an example configuration of a pixel, according to one or more embodiments.

FIG. 3 illustrates an example configuration of a pixel 10 of the display panel 1, according to one or more embodiments. Each pixel 10 comprises a plurality of pixel circuits 7 configured to display different colors, e.g., red (R), green (G), or blue (B). In various embodiments, pixel circuits 7 configured to display red, green, and blue are used as R subpixels, G subpixels, and B subpixels, respectively. The pixel circuits 7 configured to display red, green, and blue may be hereinafter referred to as R subpixel 7R, G subpixel 7G, and B subpixel 7B, respectively. Each pixel 10 may comprise at least one R subpixel 7R, at least one G subpixel 7G, and at least one B subpixel 7B. Each pixel 10 may further comprise at least one additional subpixel configured to display a color other than red, green, and blue. The combination of the colors of the subpixels of each pixel 10 is not limited to that disclosed herein. For example, each pixel 10 may further comprise a subpixel configured to display white or yellow. The display panel 1 may be configured to be adapted to subpixel rendering (SPR). In such embodiments, each pixel 10 may comprise a plurality of R subpixels 7R, a plurality of G subpixels 7G and/or a plurality of B subpixels 7B.

Referring back to FIG. 1, in one or more embodiments, the scan driver circuitry 4 is configured to drive the scan lines SC [1] to SC [N] and the emission lines EM [1] to EM [N] to select a row of pixel circuits 7 for which a write operation is performed. The scan driver circuitry 4 may be configured to, in a write operation for pixel circuits 7 located in the i-th row, for example, deassert the emission line EM [i] and assert the scan line SC [i]. The scan driver circuitry 4 may be configured to drive the scan lines SC [1] to SC [N] based on scan control signals SOUT received from the display driver 2.

In one or more embodiments, the scan control signals SOUT include an emission control signal EM_ctrl. In such embodiments, the scan driver circuitry 4 may be further configured to control, based on an emission control signal EM_ctrl, light emission from rows of pixel circuits 7 for which the write operation is not being performed. The emission control signal EM_ctrl may control a ratio of pixel circuits 7 that emit light to the pixel circuits 7 of the entire display panel 1, thereby controlling the display brightness level of the display device 100. In various embodiments, the display brightness level may be the brightness level of an entire image that is being displayed on the display panel 1.

In one or more embodiments, the emission control signal EM_ctrl is generated as a pulse-width modulated (PWM) signal and the display brightness level of the display device 100 is controlled by the duty ratio of the emission control signal EM_ctrl. The duty ratio of the emission control signal EM_ctrl may correspond to the ratio of a period during which the emission control signal EM_ctrl is asserted to one cycle period of the emission control signal EM_ctrl. In one or more embodiments, when the duty ratio of the emission control signal EM_ctrl increases, for example, the ratio of the number of asserted emission lines EM to the total number of the emission lines EM increases, and the ratio of the pixel circuits 7 that emit light also increases. Accordingly, the display brightness level of the display device 100 is increased.

In one or more embodiments, the display driver 2 is configured to drive the display panel 1 based on an input image data Din and a control data Dctrl received from the host 200 to display an image corresponding to the input image data Din on the display panel 1. The input image data Din may comprise a pixel data that describes grayscale values of the respective colors of each pixel 10 of the display panel 1. The display driver 2 may comprise interface circuitry 11, signal supply circuitry 12, and control circuitry 13.

In one or more embodiments, the interface circuitry 11 is configured to receive the input image data Din and the control data Dctrl from the host 200. The interface circuitry 11 may be further configured to forward the input image data Din to the signal supply circuitry 12 and forward the control data Dctrl to the control circuitry 13. In other embodiments, the interface circuitry 11 may be configured to process the input image data Din and send the processed input image data Din to the signal supply circuitry 12.

In one or more embodiments, the signal supply circuitry 12 is configured to supply various signals to the display panel 1 based, on least in part, on the control circuitry 13. The signal supply circuitry 12 may comprise image processing circuitry 14, grayscale voltage generator circuitry 15, data driver circuitry 16, and panel interface (I/F) circuitry 17.

In one or more embodiments, the image processing circuitry 14 is configured to generate an output voltage data Dout by performing image processing on the input image data Din received from the interface circuitry 11. The output voltage data Dout describes voltage values that specify voltage levels of drive voltages to be written into the respective pixel circuits 7 of each pixel 10 of the display panel 1.

The image processing in the image processing circuitry 14 may be controlled based by control parameters Para_ctrl received from the control circuitry 13. In embodiments where the display brightness level of the display device 100 depends on the correlation between the input image data Din and the output voltage data Dout, the display brightness level of the display device 100 may be controlled by controlling the image processing with the control parameters Para_ctrl.

In one or more embodiments, the image processing circuitry 14 may be configured to perform an IR drop correction to mitigate display mura that may appear in an image displayed on the display panel 1 due to a voltage drop over the power source lines that deliver the high-side power source voltage ELVDD from the high-side power source terminal 5 to the respective pixel circuits 7, by compensating the voltage drop over the power source lines. The control parameters Para_ctrl supplied to the image processing circuitry 14 may include amounts of the IR drop correction. The amount of IR drop may differ between respective pixel circuits 7 of each pixel 10 and may be individually determined or calculated. The IR drop correction may depend on the position of the pixel 10 of interest and the total current through the display panel 1. The total current may be the sum of the currents that flow through the pixel circuits 7 of the entire display panel 1. The voltage drop over the power source lines may decrease the brightness of the display image. Further, the amount of a decrease in the luminance level of a pixel circuit 7 increases as the total current increases and as the distance from the high-side power source terminal 5 increases. Accordingly, the amount of the IR drop correction for the pixel circuit 7 increases as the total current through the display panel 1 increases and as the distance from the high-side power source terminal 5 increases.

Figure 4:
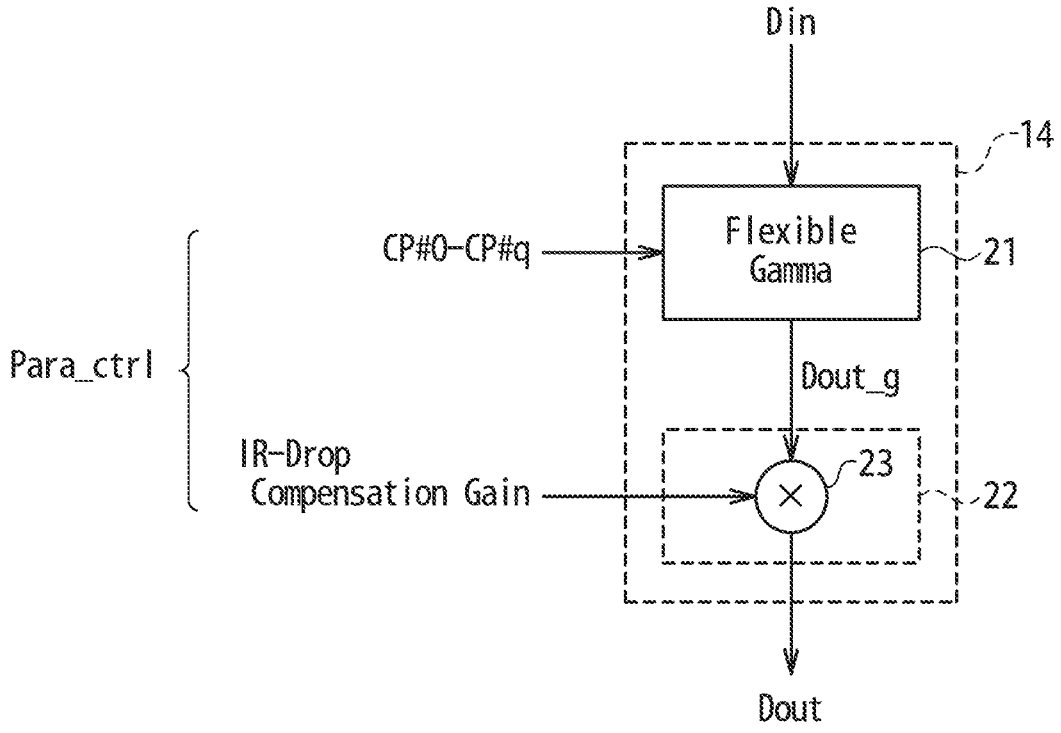
FIG. 4 illustrates an example configuration of image processing circuitry, according to one or more embodiments.

FIG. 4 illustrates an example configuration of image processing circuitry. In one or more embodiments, the image processing circuitry 14 comprises flexible gamma circuitry 21 and IR drop correction circuitry 22. In various embodiments, the flexible gamma circuitry 21 is configured to generate a gamma-processed voltage data Dout_g based on the input image data Din. The gamma-processed voltage data Dout_g may describe a voltage value that specifies a voltage level of the drive voltage for each pixel circuit 7 of each pixel 10 of the display panel 1. In various embodiments, the gamma-processed voltage data Dout_g may be generated so that the correlation between the luminance level of light emitted by a pixel circuit 7 and the grayscale value described in the input image data Din is in accordance with gamma characteristics represented by a gamma value $\gamma$. The processing performed by the flexible gamma circuitry 21 may be referred to as gamma processing. The gamma value $\gamma$ may be set to 2.2, for example.

Figure 5:
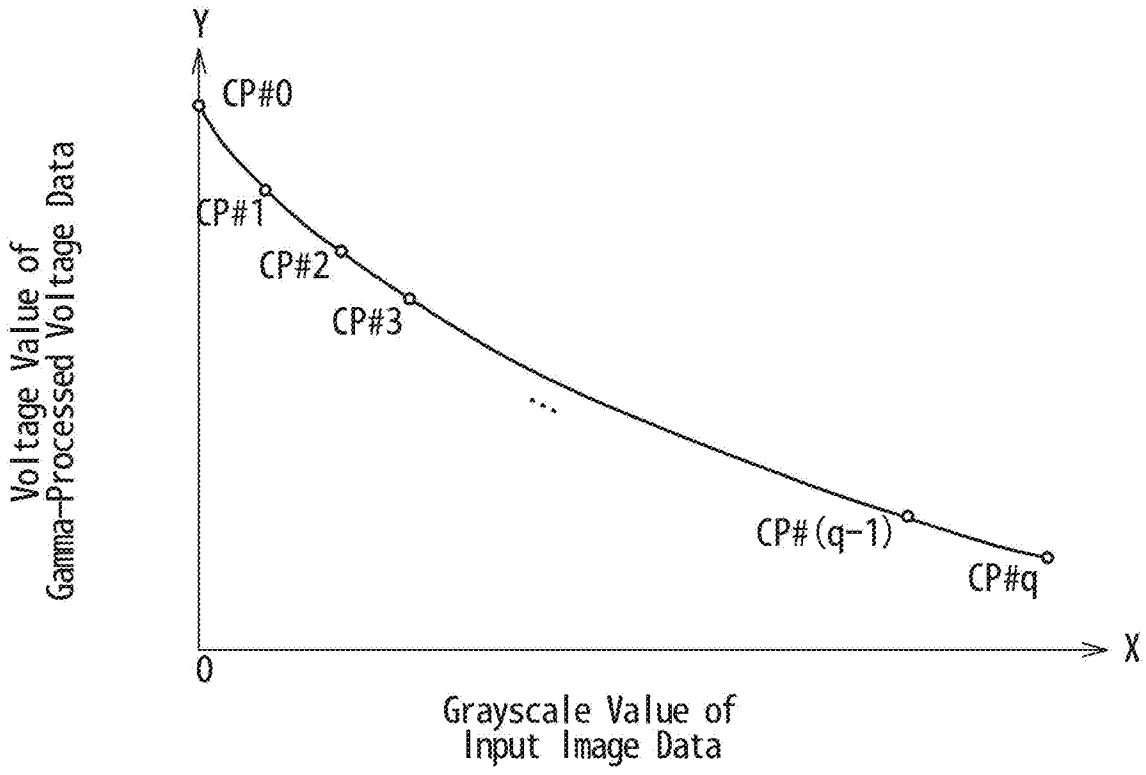
FIG. 5 illustrates a gamma curve and control points that specify the gamma curve, according to one or more embodiments.

FIG. 5 illustrates a gamma curve and control points that specify the gamma curve, according to one or more embodiments. The gamma curve represents the input-output property of the flexible gamma circuitry 21, that is, the correlation between the grayscale value of the input image data Din and the voltage value of the gamma-processed voltage data Dout_g. In the figure shown, the first coordinate axis (illustrate as the X-axis) represents the grayscale value of the input image data Din and the second coordinate axis (illustrated as the Y-axis) represent the voltage value of the gamma-processed voltage data Dout_g. In one embodiment, the flexible gamma circuitry 21 may be configured to calculate the voltage value of the gamma-processed voltage data Dout_g as the Y coordinate of a point on the gamma curve, the point having an X coordinate corresponding to a grayscale value of the input image data Din.

In various embodiments, the shape of the gamma curve is specified with a set of control points CP #0 to CP #q, where q is an integer of two or more. The gamma curve may be a free-form curve (e.g., a Bezier curve) with a shape specified by the control points CP #0 to CP #q. The positions of the control points CP #0 to CP #q may be represented by coordinates in the above-described coordinate system. In such embodiments, the control parameters Para_ctrl may comprise data indicative of the coordinates of the control points CP #0 to CP #q. The coordinates of the control point CP #i may be hereinafter referred to as (CPXi, CPYi), where CPXi is the coordinate on the first coordinate axis or the X axis of the control point CP #i, and CPYi is the coordinate on the second coordinate axis or the Y axis of the control point CP #i. CPXi and CPYi may be hereinafter referred to as X coordinate CPXi and Y coordinate CPYi, respectively.

In one or more embodiments, the flexible gamma circuitry 21 is configured to flexibly control the shape of the gamma curve by adjusting the positions of the control points CP #0 to CP #q. In various embodiments, the flexible gamma circuitry 21 is configured to adjust the X coordinates CPX0 to CPXq of the control points CP #0 to CP #q used for generation of a voltage value of the gamma-processed voltage data Dout_g. This allows scaling (that is, enlarging or shrinking) the gamma curve in a direction parallel to the first coordinate axis or the X axis. In one or more embodiments, when the gamma curve is enlarged in the direction parallel to the first coordinate axis or the X axis, this increases the voltage value of the gamma-processed output voltage data Dout_g and accordingly increases the drive voltage supplied to the pixel circuit 7. In such embodiments, the luminance level of the pixel circuit 7 decreases when the gamma curve is enlarged in the direction parallel to the first coordinate axis or the X axis.

Referring back to FIG. 4, in one or more embodiments, the IR drop correction circuitry 22 is configured to correct the gamma-processed voltage data Dout_g based on the control parameters Para_ctrl to generate the output voltage data Dout. The control parameters Para_ctrl may comprise an IR drop compensation gain, and the IR drop correction circuitry 22 may comprise a multiplier 23. In such embodiments, the multiplier 23 may be configured to generate a voltage value of the output voltage data Dout by multiplying a voltage value of the gamma-processed voltage data Dout_g by the IR drop compensation gain.

In one or more embodiments, the grayscale voltage generator circuitry 15 is configured to supply (m+1) grayscale voltages V0 to Vm to the data driver circuitry 16. In various embodiments, the (m+1) grayscale voltages V0 to Vm have different voltage levels from each other. In embodiments where grayscale voltage V0 is the highest grayscale voltage and grayscale voltage Vm is the lowest grayscale value, the intermediate grayscale voltages V1 to V(m−1) may be generated through voltage dividing of the grayscale voltages V0 and Vm. Display brightness level of the display device 100 may depend on a range of the drive voltages supplied to the pixel circuits 7. The range may have an upper limit of grayscale voltage V0 and lower limit of grayscale voltage Vm. The voltage level of the grayscale voltage V0 may be specified by a V0 command value V0* supplied from the control circuitry 13, and the voltage level of the grayscale voltage Vm may be specified by a Vm command value Vm*. In such embodiments, the voltage range of the drive voltages, that is, the display brightness level of the display device 100 can be controlled by controlling the V0 command value V0* and the Vm command value Vm*.

In one or more embodiments, the data driver circuitry 16 is configured to output, based on the output voltage data Dout from image processing circuitry 14 and grayscale voltage V0-Vm, drive voltages to be written into the respective pixel circuits 7 of the respective pixels 10 of the display panel 1. The data driver circuitry 16 may be configured to select a drive voltage to be written into each pixel circuit 7 from among the grayscale voltages V0 to Vm based on the voltage value of the output voltage data Dout associated with each pixel circuit 7. In one or more embodiments, the drive voltage to be written into each pixel circuit 7 ranges from Vm to V0 and increases as the voltage value of the output voltage data Dout increases.

In one or more embodiments, the panel interface circuitry 17 is configured to generate scan control signals SOUT to control the scan driver circuitry 4 of the display panel 1. In such embodiments, the scan driver circuitry 4 may be configured to drive the scan lines SC and the emission lines EM based on the scan control signals SOUT. The scan control signal SOUT may comprise the above-described emission control signal EM_ctrl. In such embodiments, the panel interface circuitry 17 may be configured to control the duty ratio of the emission control signal EM_ctrl based on the emission command value Emission* received from the control circuitry 13. For example, the duty ratio of the emission control signal EM_ctrl may increase as the emission command value Emission* increases. In embodiments where the display brightness level of the display device 100 is controllable with the emission control signal EM_ctrl, the display brightness level is controllable with the emission command value Emission*.

The panel interface circuitry 17 may be further configured to control the high-side power source voltage ELVDD and the low-side power source voltage ELVSS by supplying a PMIC control signal PMIC_ctrl to the PMIC 300. In such embodiments, the panel interface circuitry 17 may be configured to control the low-side power source voltage ELVSS based on an ELVSS command value ELVSS* received from the control circuitry 13. In one or more embodiments, the low-side power source voltage ELVSS is set lower than the lowest grayscale voltage Vm.

In one or more embodiments, the control circuitry 13 is configured to control the operation of the signal supply circuitry 12 based on the control data Dctrl received from the host 200. In various embodiments, the control data Dctrl comprises a display brightness value (DBV) and the control circuitry 13 is configured to control the display brightness level of the display device 100 based on the DBV. The DBV may be generated based on a user operation. For example, when an instruction to adjust the brightness of an image displayed on the display device 100 is manually input to an input device (not illustrated), the host 200 may generate the DBV based on this instruction to adjust the display brightness level. The input devices may be a touch panel disposed on at least a portion of the display panel 1, a cursor control device, and mechanical and/or non-mechanical buttons, among others.

Figure 6:
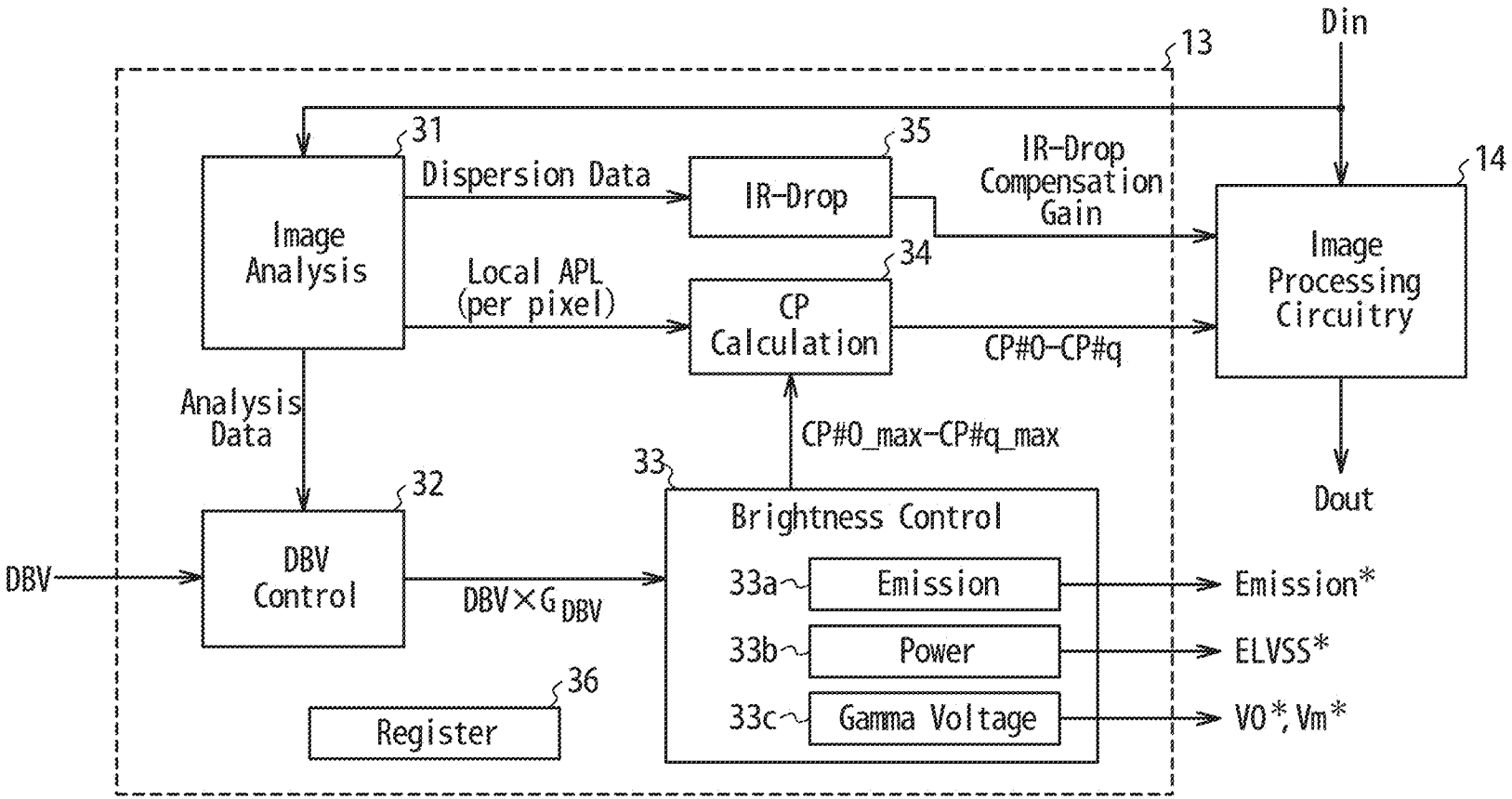
FIG. 6 illustrates an example configuration of control circuitry, according to one or more embodiments.

FIG. 6 illustrates an example configuration of control circuitry 13. In the embodiment illustrated, the control circuitry 13 comprises image analysis circuitry 31, DBV control circuitry 32, brightness control circuitry 33, CP calculation circuitry 34, IR drop correction control circuitry 35, and register circuitry 36.

The image analysis circuitry 31 is configured to analyze the input image data Din and generate analysis data of the display image corresponding to the input image data Din. The image analysis circuitry 31 may be further configured to generate dispersion data that indicate a dispersion of luminance levels of the pixels 10.

The DBV control circuitry 32 is configured to generate a brightness enhancement gain $G_{DBV}$ based on the analysis data and further generate a maximum brightness enhancing DBV based on the DBV and the brightness enhancement gain $G_{DBV}$. The highest brightness enhancing DBV may be the product of the DBV and the brightness enhancement gain $G_{DBV}$.

The brightness control circuitry 33 is configured to control an analog operation of the signal supply circuitry 12 based on the highest brightness enhancing DBV, which may be the product of the DBV and $G_{DBV}$. The brightness control circuitry 33 may comprise emission control circuitry 33*a*, power source control circuitry 33*b*, and gamma voltage control circuitry 33*c*. The emission control circuitry 33*a* is configured to generate the emission command value Emission* based on the highest brightness enhancing DBV. The power source control circuitry 33*b* is configured to generate the ELVSS command value ELVSS* based on the highest brightness enhancing DBV. The gamma voltage control circuitry 33*c* is configured to generate the V0 command value V0* and the Vm command value Vm* based on the highest brightness enhancing DBV.

The CP calculation circuitry 34 is configured to generate control points CP #0 to CP #q to be set to the flexible gamma circuitry 21 of the image processing circuitry 14.

The IR drop correction control circuitry 35 is configured to calculate the IR drop compensation gains based on the dispersion data received from the image analysis circuitry 31.

The register circuitry 36 is configured to store one or more register values to control the operation of the control circuitry 13. The register circuitry 36 may be configured so that the register values are rewritable from an external device, such as the host 200.

In one or more embodiments, the control circuitry 13 is configured to control analog operation of the signal supply circuitry 12 based on the input image data Din. This enables an adaptive control of the analog operation depending on contents of the input image data Din. The control circuitry 13 may be configured to control the emission control signal EM_ctrl and/or the low-side power source voltage ELVSS. The emission control signal EM_ctrl may be controlled by generating the emission command value Emission* based on the input image data Din. The low-side power source voltage ELVSS may be controlled by generating the ELVSS command value ELVSS* based on the input image data Din. The control of the analog operation may comprise control of the voltage range of the drive voltages supplied to the pixel circuits 7 based on the input image data Din. The control of the voltage range of the drive voltages may comprise control of the highest grayscale voltage V0 and/or control of the lowest grayscale voltage Vm. The above-described analog operation control may have an effect on the brightness of the entire display image in the display area 3. The highest grayscale voltage V0 may be controlled by generating the V0 command value V0* based on the input image data Din, and the lowest grayscale voltage Vm may be controlled by generating the Vm command value Vm* based on the input image data Din.

The control circuitry 13 may be configured to determine or calculate, based on the input image data Din, average picture levels (APLs) of respective partial areas defined in the display area 3 of the display panel 1 and implement the above-described analog operation control based on the calculated APLs. The APLs calculated for the respective partial areas may be hereinafter referred to as local APLs. In one or more embodiments, the APL of a partial area of interest may be calculated as the average of the maximum value of the grayscale values of the subpixels of all the colors (e.g., red, green, and blue) of each pixel 10 in the partial area. In one or more embodiments, the control circuitry 13 may be configured to implement the above-described analog operation control based on the highest local APL among the local APLs calculated for the respective partial areas. This operation may enable displaying the image corresponding to the input image data Din on the display panel 1 more brightly when the display image contains a bright portion.

Figure 7:
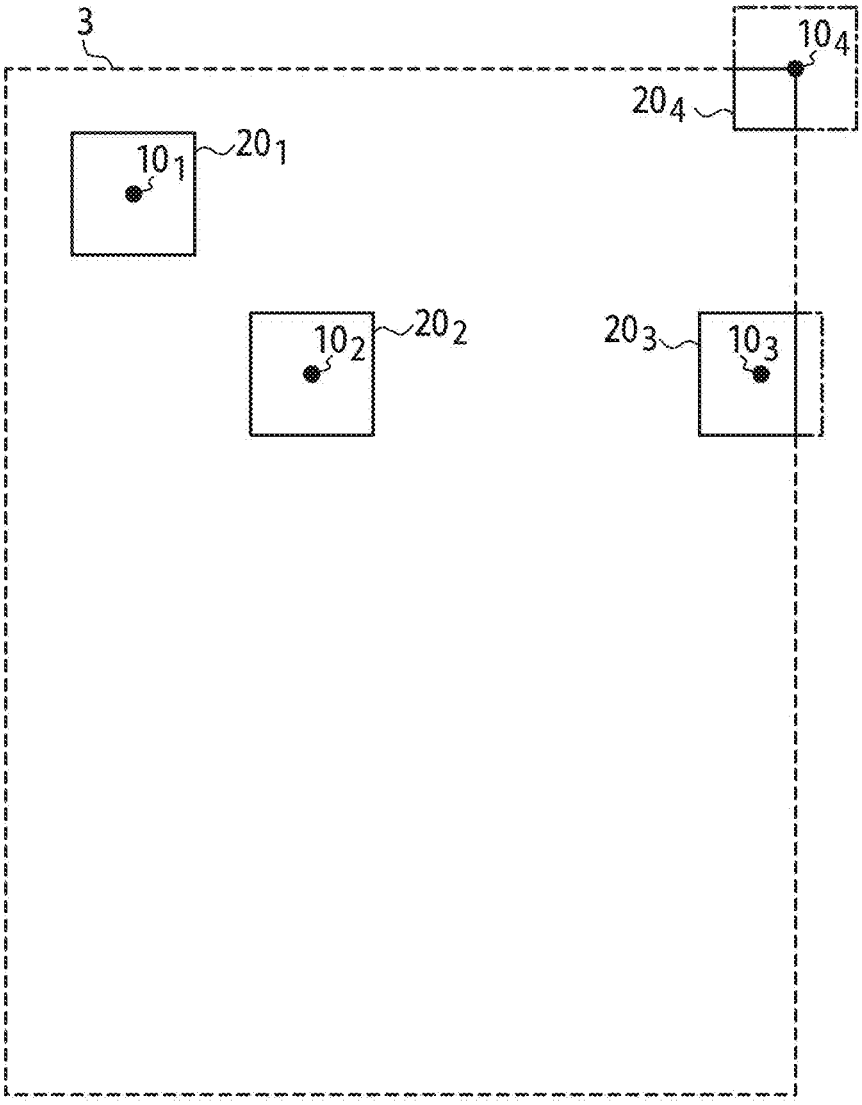
FIG. 7 illustrates an example definition of partial areas, according to one or more embodiments.

FIG. 7 illustrates an example definition of partial areas, according to one or more embodiments. As illustrated in FIG. 7, a plurality of partial areas, denoted by numeral 20, are associated with pixels 10 of the display panel 1, respectively. Each partial area 20 may be defined to include the pixel 10 corresponding thereto. For example, the partial areas $\mathbf{20}_1$ to $\mathbf{20}_4$ associated with the pixels $\mathbf{10}_1$ to $\mathbf{10}_4$ are defined to include the pixels $\mathbf{10}_1$ to $\mathbf{10}_4$, respectively. In the following, the local APL of a partial area 20 associated with a pixel 10 may be simply referred to as local APL associated with the pixel 10.

When the corresponding pixel 10 of a partial area 20 is of a sufficient distance from the edge of the display area 3, the partial area 20 may be defined as a rectangular area that has a predetermined width and height, wherein the corresponding pixel 10 thereof is located at the geometric center of the rectangular region. In FIG. 7, the partial areas $\mathbf{20}_1$ and $\mathbf{20}_2$ are illustrated as rectangular areas that have the predetermined width and height, where the corresponding pixels $\mathbf{10}_1$ and $\mathbf{10}_2$ are sufficiently apart from the edge of the display area 3 compared with the dimensions of the partial areas $\mathbf{20}_1$ and $\mathbf{20}_2$ and located at the geometric centers of the partial areas $\mathbf{20}_1$ and $\mathbf{20}_2$. When the corresponding pixel 10 of a partial area 20 is located proximate to or on the edge of the display area 3, the partial area 20 may be defined as a portion of a rectangular area that has the above-described predetermined width and height, wherein the portion is located in the display area 3 and the corresponding pixel 10 of the partial area 20 is located at the geometric center of the rectangular region. In one or more embodiments, the pixel $\mathbf{10}_3$ corresponding to the partial area $\mathbf{20}_3$ is located close to the edge of the display area 3, and the pixel $\mathbf{10}_4$ corresponding to the partial area $\mathbf{20}_4$ is located on the edge of the display area 3. In such embodiments, the partial areas $\mathbf{20}_3$ and $\mathbf{20}_4$ may be defined as portions of rectangular regions that have the same width and height as the partial areas $\mathbf{20}_1$ and $\mathbf{20}_2$, respectively, wherein the portions are located in the display area 3, and the pixels $\mathbf{10}_3$ and $\mathbf{10}_4$ are located at the geometric centers of the rectangular regions. While FIG. 7 only illustrates the partial areas $\mathbf{20}_1$ to $\mathbf{20}_4$ corresponding to the pixels $\mathbf{10}_1$ to $\mathbf{10}_4$, partial areas 20 may be defined for all the pixels 10 in the display area 3. While FIG. 7 illustrates that the partial areas $\mathbf{20}_1$ to $\mathbf{20}_4$ are rectangular, the partial areas 20 may have a different shape.

In other embodiments, the control circuitry 13 may be configured to calculate an APL of an entire display image in the display area 3 of the display panel 1 based on the input image data Din and control the analog operation of the signal supply circuitry 12 based on the calculated APL. This operation may enable displaying the display image corresponding to the input image data Din more brightly when the display image is bright. In the following, the APL of the entire display image may be referred to as global APL to distinguish the same from the above-described local APLs.

In other embodiments, the control circuitry 13 may be configured to selectively perform the analog operation control based on the highest local APL and the analog operation control based on the global APL. The control circuitry 13 may be configured to control the analog operation of the signal supply circuitry 12 based on the highest local APL in a local APL mode, which may be also referred to as first operation mode. The control circuitry 13 may be further configured to control the analog operation of the signal supply circuitry 12 based on the global APL in a global APL mode, which may be also referred to as second operation mode. The selection of the operation mode may be based on a register value stored in the register circuitry 36. In other embodiments, the selection of the operation mode may be based on a register value stored in a separate memory apart from the control circuitry 13.

In one or more embodiments, the control circuitry 13 is configured to increase the brightness of a bright portion of a display image having a bright portion and a dark portion by controlling an analog operation of the signal supply circuitry 12. Since the analog operation may have an effect of the brightness of the entire display image in the display area 3, in one or more embodiments, the control circuitry 13 is further configured to cancel the increase in the brightness in the dark portion through a control of the image processing in the image processing circuitry 14. This may effectively improve the contrast of the display image. In various embodiments, when the emission control signal EM_ctrl is controlled to increase the luminance level of a pixel 10 of interest, the image processing for the pixel 10 of interest may be performed to cancel the increase in the luminance level of the pixel 10 of interest based on the local APL of the partial area 20 corresponding to the pixel 10 of interest. In one or more embodiments, the control of the image processing in the image processing circuitry 14 may be achieved by adjusting the coordinates of the control points CP #0 to CP #q and/or adjusting IR drop compensation gains.

In one or more embodiments, the image analysis circuitry 31 is configured to analyze the input image data Din to calculate one or more feature values of the display image corresponding to the input image data Din. The feature values may comprise local APLs of the respective partial areas 20, a global APL of the display image, or a dispersion of the luminance levels of the pixels 10. The image analysis circuitry 31 may be configured to calculate the local APLs of the respective partial areas 20 defined in the display area 3 of the display panel 1 based on the input image data Din. The image analysis circuitry 31 may be configured to calculate the global APL of the display image based on the input image data Din. The image analysis circuitry 31 may be configured to generate an analysis data indicative of at least one of the highest local APL among the local APLs of the partial areas 20 and the global APL. The image analysis circuitry 31 may be further configured to generate a dispersion data indicative of the dispersion of the luminance levels of the pixels 10 in the display image based on the input image data Din. The dispersion data may indicate at least one of: the difference between the maximum and minimum values of the luminance levels of the pixels 10; the variation of the luminance levels of the pixels 10; the average absolute deviation of the luminance levels of the pixels 10; and the standard deviation of luminance levels of the pixels 10.

In one or more embodiments, the DBV control circuitry 32 is configured to generate a brightness enhancement gain $G_{DBV}$ based on the analysis data and further generate a maximum brightness enhancing DBV based on the DBV and the brightness enhancement gain $G_{DBV}$. The maximum brightness enhancing DBV may be calculated as the product of the DBV and the brightness enhancement gain $G_{DBV}$. In various embodiments, the maximum brightness enhancing DBV is used as a parameter for controlling the brightness of a portion of the highest brightness in the display image displayed in the display area 3.

Figure 8:
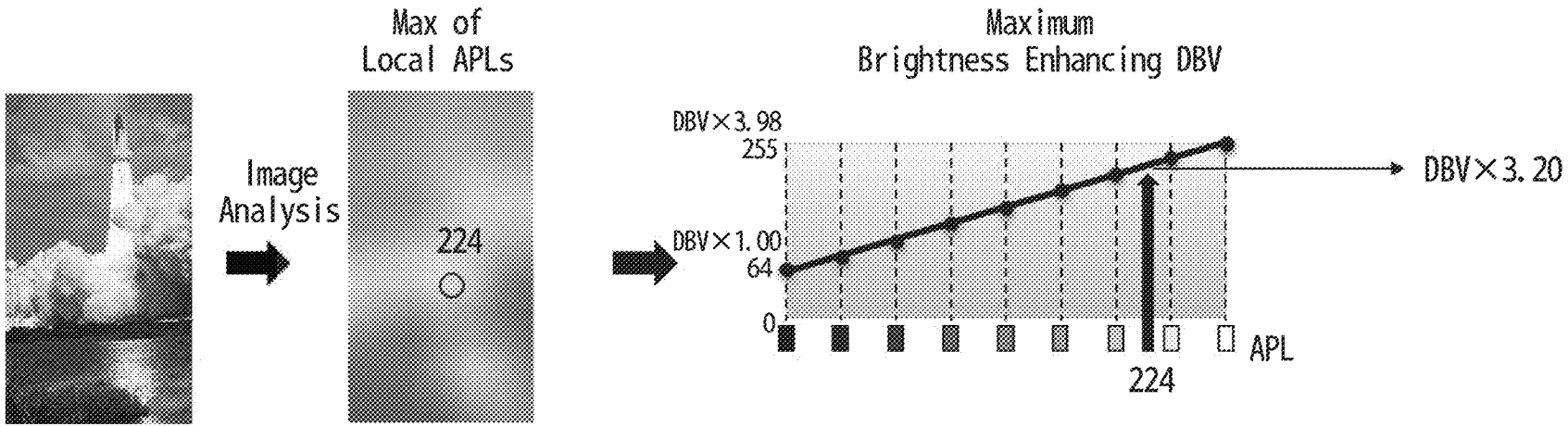
FIG. 8 illustrates an example calculation of a highest brightness enhancing display brightness value (highest brightness enhancing DBV) based on the highest local average picture level (highest local APL), according to one or more embodiments.

In embodiments where the analysis data comprises the highest local APL, as illustrated in FIG. 8, the DBV control circuitry 32 may be configured to generate the brightness enhancement gain $G_{DBV}$ based on the highest local APL and further generate the highest brightness enhancing DBV based on the DBV and the brightness enhancement gain $G_{DBV}$. In such embodiments, the DBV control circuitry 32 may comprise a brightness enhancement gain table indicative of a correlation between the highest local APL and the brightness enhancement gain $G_{DBV}$. The DBV control circuitry 32 may be further configured to generate the brightness enhancement gain $G_{DBV}$ through a table lookup on the brightness enhancement gain table based on the highest local APL. In one or more embodiments, the brightness enhancement gain $G_{DBV}$ may increase as the highest local APL increases. Illustrated in FIG. 8 is an embodiment where the highest brightness enhancing DBV is calculated as the product of the DBV and the brightness enhancement gain $G_{DBV}$ and the brightness enhancement gain $G_{DBV}$ is 3.20.

Figure 9:
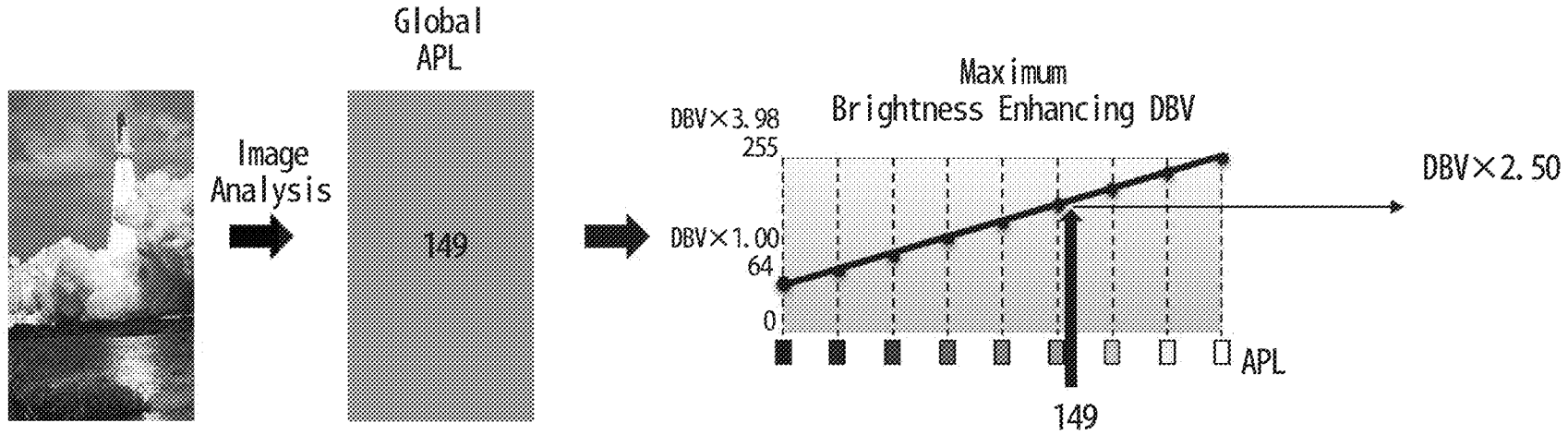
FIG. 9 illustrates an example calculation of a highest brightness enhancing DBV based on a global APL, according to one or more embodiments.

In embodiments where the analysis data comprises the global APL, as illustrated in FIG. 9, the DBV control circuitry 32 may be configured to generate the brightness enhancement gain $G_{DBV}$ based on the global APL and further generate the highest brightness enhancing DBV based on the DBV and the brightness enhancement gain $G_{DBV}$. In such embodiments, the DBV control circuitry 32 may comprise a brightness enhancement gain table indicative of a correlation between the global APL and the brightness enhancement gain $G_{DBV}$. The DBV control circuitry 32 may be further configured to generate the brightness enhancement gain $G_{DBV}$ through a table lookup on the brightness enhancement gain table based on the global APL. In one or more embodiments, the brightness enhancement gain $G_{DBV}$ may increase as the global APL increases. Illustrated in FIG. 9 is an embodiment where the highest brightness enhancing DBV is calculated as the product of the DBV and the brightness enhancement gain $G_{DBV}$ and the brightness enhancement gain $G_{DBV}$ is 2.50.

In embodiments where the display driver 2 has the local APL mode and the global APL mode, the DBV control circuitry 32 may be configured to generate the brightness enhancement gain $G_{DBV}$ based on a selection between the local APL mode and the global APL mode. In one or more embodiments, the DBV control circuitry 32 may be configured to, in the local APL mode, generate the brightness enhancement gain $G_{DBV}$ based on the highest local APL and generate the highest brightness enhancing DBV based on the DBV and the brightness enhancement gain $G_{DBV}$. In one or more embodiments, the DBV control circuitry 32 may be configured to, in the global APL mode, generate the brightness enhancement gain $G_{DBV}$ based on the global APL and further generate the highest brightness enhancing DBV based on the DBV and the brightness enhancement gain $G_{DBV}$. The selection between the local APL mode and the global APL mode may be based on a register value stored in the register circuitry 36.

Referring back to FIG. 6, in one or more embodiments, the brightness control circuitry 33 is configured to control the analog operation of the signal supply circuitry 12 based on the highest brightness enhancing DBV, which may be the product of the DBV and $G_{DBV}$. In one or more embodiments, the brightness control circuitry 33 is configured to generate the emission command value Emission*, the V0 command value V0*, the Vm command value Vm*, and the ELVSS command value ELVSS* based on the highest brightness enhancing DBV. The emission command value Emission* may be generated to increase the duty ratio of the emission control signal EM_ctrl as the highest brightness enhancing DBV increases. In various embodiments, an increase in the duty ratio of the emission control signal EM_ctrl causes an increase in the ratio of pixel circuits 7 that emit light, increasing the highest brightness achievable on the display panel 1. The Vm command value Vm* may be generated to decrease the lowest grayscale voltage Vm as the highest brightness enhancing DBV increases. In various embodiments, a decrease in the lowest grayscale voltage Vm causes an increase in the maximum current through the light emitting elements 8 of the pixel circuits 7, increasing the highest brightness achievable on the display panel 1. The ELVSS command value ELVSS* may be generated to decrease the low-side power source voltage ELVSS as the highest brightness enhancing DBV increases. The ELVSS command value ELVSS* may be generated so that the low-side power source voltage ELVSS is lower than the lowest grayscale voltage Vm.

In one or more embodiments, the brightness control circuitry 33 may be further configured to generate highest brightness control points CP #0_max to CP #q_max based on the highest brightness enhancing DBV. The highest brightness control points CP #0_max to CP #q_max may be a set of control points that represent the shape of a gamma curve suitable for a portion of the highest brightness of the display image displayed in the display area 3. The brightness control circuitry 33 may be configured to store a plurality of sets of control points CP #0 to CP #q and select the highest brightness control points CP #0_max to CP #q_max from among the stored sets of control points CP #0 to CP #q based on the highest brightness enhancing DBV.

In one or more embodiments, the CP calculation circuitry 34 is configured to generate control points CP #0 to CP #q to be set to the flexible gamma circuitry 21 of the image processing circuitry 14 by modifying the highest brightness control points CP #0_max to CP #q_max received from the brightness control circuitry 33 based on the local APL calculated for each pixel 10. In embodiments where the analog operation of the signal supply circuitry 12 is controlled by the brightness control circuitry 33 to increase the brightness of a bright portion of the display image, the CP calculation circuitry 34 may be configured to generate the control points CP #0 to CP #q to cancel the increase in a dark portion of the display image by the image processing in the image processing circuitry 14. The control points CP #0 to CP #q to be set to the flexible gamma circuitry 21 may be calculated for each pixel 10.

Figure 10:
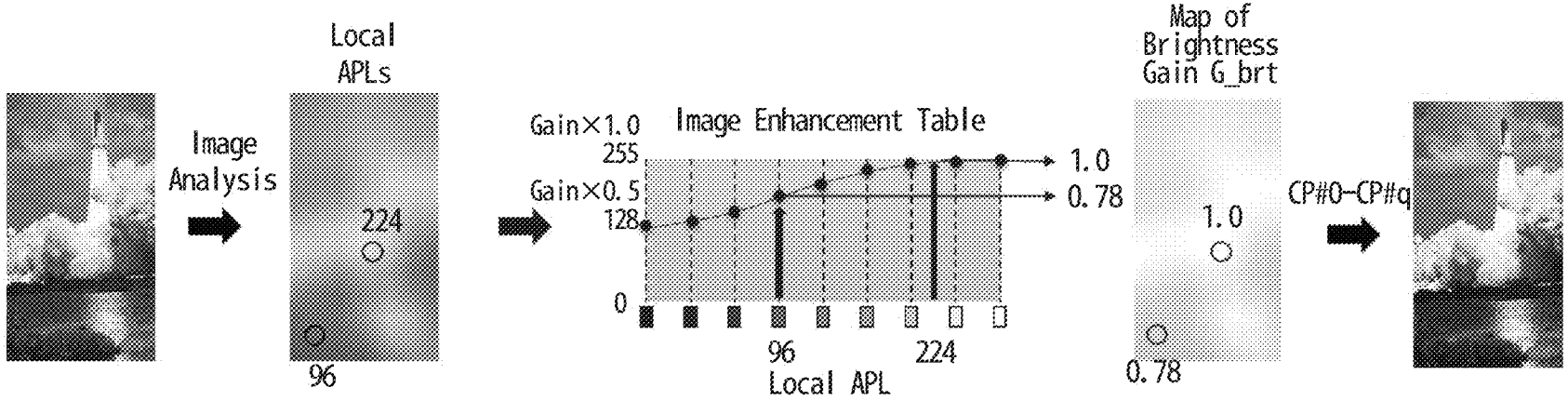
FIG. 10 illustrates generation of a brightness gain for each pixel, according to one or more embodiments.

Referring to FIG. 10, in one or more embodiments, the control points CP #0 to CP #q used for the generation of the gamma-processed voltage data Dout_g for a pixel 10 of interest may be generated based on a brightness gain G_brt of the pixel 10 of interest. In one or more embodiments, the brightness gain G_brt of the pixel 10 of interest represents a degree to decrease the luminance level of the pixel 10 of interest in the image processing in the image processing circuitry 14. In various embodiments, the brightness gain G_brt of the pixel 10 of interest is calculated based on the local APL associated with the pixel 10 of interest and the highest local APL of the display image.

The CP calculation circuitry 34 may comprise an image enhancement table that describes a correlation of local APLs with desired luminance levels for the respective local APLs. Further, the CP calculation circuitry 34 may be configured to refer to the image enhancement table in generating the brightness gain G_brt of the pixel 10 of interest. In such embodiments, the CP calculation circuitry 34 may be configured to generate a desired luminance level corresponding to the local APL associated with the pixel 10 of interest and a desired luminance level corresponding to the highest local APL through table lookups on the image enhancement table and determine the brightness gain G_brt as a ratio of the desired luminance level corresponding to the local APL associated with the pixel 10 of interest to the desired luminance level corresponding to the highest local APL. Illustrated in FIG. 10 is an example in which the local APL associated with the pixel 10 of interest is 96, the highest local APL is 224, and the brightness gain G_brt is 0.78.

Figure 11:
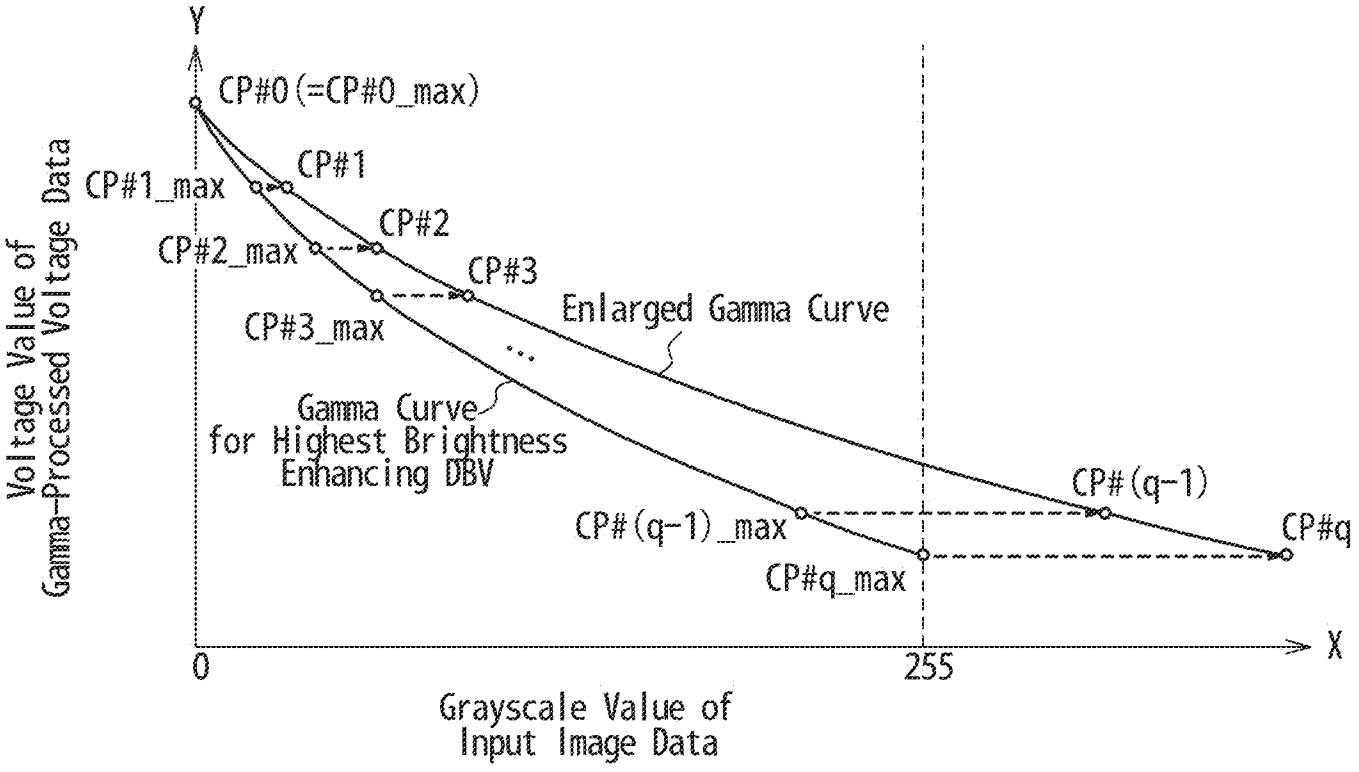
FIG. 11 illustrates generation of control points, according to one or more embodiments.

Referring back to FIG. 6, in various embodiments, the control points CP #0 to CP #q used to generate the gamma-processed voltage data Dout_g for the pixel 10 of interest are generated based on the brightness gain G_brt and the highest brightness control points CP #0_max to CP #q_max. In one or more embodiments, the X coordinates CPX0 to CPXq of the control points CP #0 to CP #q are respectively calculated by multiplying the X coordinates CPX0_max to CPXq_max of the highest brightness control points CP #0_max to CP #q_max by a coefficient $\alpha$ ($\geq 1$) calculated based on the brightness gain G_brt. In one or more embodiments, the Y coordinates CPY0 to CPYq of the control points CP #0 to CP #q are determined as being identical to the Y coordinates CPY0 to CPYq of the highest brightness control points CP #0_max to CP #q_max, respectively. This enlarges the gamma curve used to generate the gamma-processed voltage data Dout_g by $\alpha$ times in the X axis direction as illustrated in FIG. 11. In one or more embodiments, the coefficient $\alpha$ may be calculated in accordance with the following expression (1):

$$\alpha = 1/G_brt^{1/\gamma}, \tag{1}$$

where $\gamma$ is the gamma value set to the display device 100. The gamma value $\gamma$ may be 2.2, for example. In embodiments where the coefficient $\alpha$ is calculated in accordance with expression (1), the gamma curve is enlarged by $\alpha$ times in the direction parallel to the first coordinate axis or the X axis, and this reduces the luminance level of each pixel circuit 7 by G_brt times ($\leq 1$). The use of the control points CP #0 to CP #q thus calculated in the generation of the gamma-processes voltage data Dout_g for the pixel 10 of interest enables reducing the luminance level of the pixel 10 of interest while suppressing a change in the gamma characteristics of the display device 100.

Referring back to FIG. 6, in embodiments where the global APL is used to control the analog operation of the signal supply circuitry 12, the highest brightness control points CP #0_max to CP #q_max may be used as the control points CP #0 to CP #q set to the flexible gamma circuitry 21 without modification. In embodiments where the display device 100 has the global APL mode and the local APL mode, the CP calculation circuitry 34 may be configured to output the highest brightness control points CP #0_max to CP #q_max as the control points CP #0 to CP #q set to the flexible gamma circuitry 21 without modification in the global APL mode. In such embodiments, the CP calculation circuitry 34 may be further configured to generate, in the local APL mode, the control points CP #0 to CP #q set to the flexible gamma circuitry 21 by modifying the highest brightness control points CP #0_max to CP #q_max based on the local APL calculated for each pixel 10.

In one or more embodiments, the IR drop correction control circuitry 35 is configured to calculate the IR drop compensation gains based on the dispersion data received from the image analysis circuitry 31. The IR drop correction control circuitry 35 may be configured to select execution or withholding of the IR drop correction based on the dispersion of the luminance levels of the pixels 10 indicated by the dispersion data. When the IR drop correction is executed, IR drop compensation gains may be calculated based on the position of the pixel 10 of interest and the total current through the display panel 1. When the IR drop correction is withheld, the IR drop compensation gains are unconditionally set to "1", and the gamma-processed voltage data Dout_g may be outputted as the output voltage data Dout without modification.

In one or more embodiments, the IR drop correction is withheld when the dispersion data indicates the dispersion of the luminance levels of the pixels 10 exceeds a predetermined threshold. In embodiments where the grayscale values of the input image data Din are eight-bit values ranging between 0 and 255, inclusive, the luminance levels of the pixels 10 may be determined as values ranging between 0 and 255, inclusive and the predetermined threshold may be set to a value between 0 and 255, inclusive. The predetermined threshold may depend on desired contrast of the display image. The IR drop correction may reduce the contrast while reducing mura caused by a voltage drop over a power source line. In one or more embodiments, when the dispersion of the luminance levels of the pixels 10 exceeds a predetermined threshold and therefore the contrast of the display image is to be increased, the IR drop correction may be withheld to suppress a decrease in the contrast.

In embodiments where the dispersion data indicates the difference between the maximum value and the minimum value of the luminance levels of the pixels 10 of the display image, the execution or withholding of the IR drop correction may be selected based on a comparison of the difference between the maximum value and the minimum value with a predetermined threshold value. In one or more embodiments, the IR drop correction is withheld when the difference between the maximum value and the minimum value of the luminance levels of the pixels 10 is larger than the predetermined threshold value. In one or more embodiments, the IR drop correction is executed when the difference between the maximum value and the minimum value of the luminance levels of the pixels 10 is smaller than the predetermined threshold value.

In one or more embodiments, an inverse correction that causes an effect opposite to the IR drop correction may be executed when the dispersion of the luminance levels of the pixels 10 indicated is large. The inverse correction may be executed to enhance mura that results from a voltage drop over the power source lines. The inverse correction may be executed to reduce the luminance level of the pixel 10 of interest more largely as the total current through the display panel 1 increases. In one or more embodiments, the inverse correction may enhance the contrast of the display image. The execution of the inverse correction may be controlled based on a comparison of the difference between the maximum value and the minimum value of the luminance levels of the pixels 10 with a predetermined threshold value. For example, the inverse correction may be executed when the difference between the maximum value and the minimum value is larger than a predetermined threshold value. In embodiments where the grayscale values of the input image data Din are 8-bit values ranging between 0 and 255, inclusive, the luminance levels of the pixels 10 may be determined as values ranging between 0 and 255, inclusive and the predetermined threshold value may be set to a value between 0 and 255, inclusive, depending on desired contrast of the display image.

Figure 12:
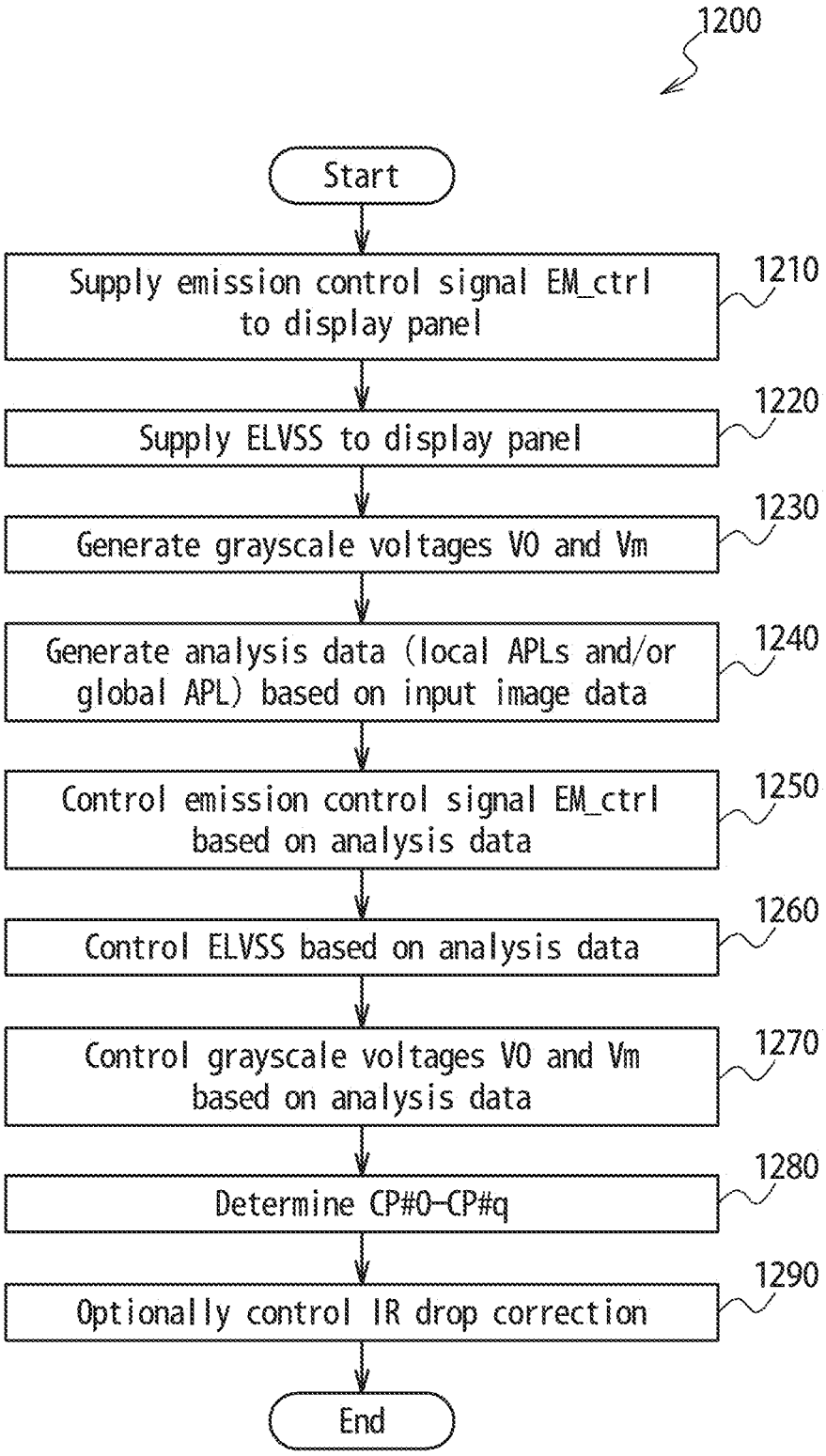
FIG. 12 illustrates an example method for controlling signal processing circuitry, according to one or more embodiments.

Method 1200 of FIG. 12 illustrates steps for controlling the signal supply circuitry 12, in one or more embodiments. It should be noted that the order of the steps may be altered from the order illustrated.

In the embodiment illustrated, the emission control signal EM_ctrl, which controls the ratio of pixel circuits 7 that emit light to the pixel circuits 7 of the entire display panel 1, is supplied to the display panel 1 from the panel interface circuitry 17 at step 1210. The low-side power source voltage ELVSS is supplied to the display panel 1 from the PMIC 300 at step 1220. The grayscale voltages V0 and Vm, which may be the highest and lowest grayscale voltages, are generated at step 1230.

At step 1240, the analysis data are generated based on the input image data Din by the image analysis circuitry 31. The analysis data may indicate the local APLs of the respective partial areas 20 and/or the global APL of the display image. The local APLs may be respectively calculated for all the pixels 10 in the display area 3 of the display panel 1.

At step 1250, the emission control signal EM_ctrl is controlled based on the analysis data, in one or more embodiments. The duty ratio of the emission control signal EM_ctrl may be controlled based on the analysis data. In one or more embodiments, the emission control signal EM_ctrl is controlled based on the local APLs of the respective partial areas 20. In some embodiments, the emission control signal EM_ctrl is controlled based on the highest local APL. The duty ratio of the emission control signal EM_ctrl may increase as the highest local APL increases. This may result in an increase in the duty ratio of the of the emission control signal EM_ctrl when the image contains a bright portion, improving the contrast of the displayed image. In other embodiments, the emission control signal EM_ctrl is controlled based on the global APL.

At step 1260, the low-side power source voltage ELVSS is optionally controlled based on the analysis data. The low-side power source voltage ELVSS may be based on the local APLs of the respective partial areas 20. In some embodiments, the low-side power source voltage ELVSS is controlled based on the highest local APL. In other embodiments, the low-side power source voltage ELVSS is controlled based on the global APL.

At step 1270, the grayscale voltages V0 and Vm are optionally controlled based on the analysis data. The grayscale voltages V0 and Vm may be based on the local APLs of the respective partial areas 20. In some embodiments, the grayscale voltages V0 and Vm are controlled based on the highest local APL. In other embodiments, the grayscale voltages V0 and Vm are controlled based on the global APL.

At step 1280, the control points CP #0 to CP #q are determined or calculated by the CP calculation circuitry 34 in one or more embodiments. In embodiments where the control points CP #0 to CP #q are determined or calculated for each pixel 10, the control points CP #0 to CP #q are determined or calculated based on the local APL associated with the pixel 10. The control points CP #0 to CP #q may be determined or calculated based on the local APL associated with the pixel 10 of interest to cancel an increase in the luminance level of the pixel 10 of interest caused by the control of the emission control signal EM_ctrl, the low-side power source voltage ELVSS, and/or the grayscale voltages V0 and Vm.

At step 1290, the IR drop correction is optionally controlled. In one or more embodiments, the IR drop correction control circuitry 35 may select execution or withholding of the IR drop correction based on the dispersion of the luminance levels of the pixels 10.

Figure 13:
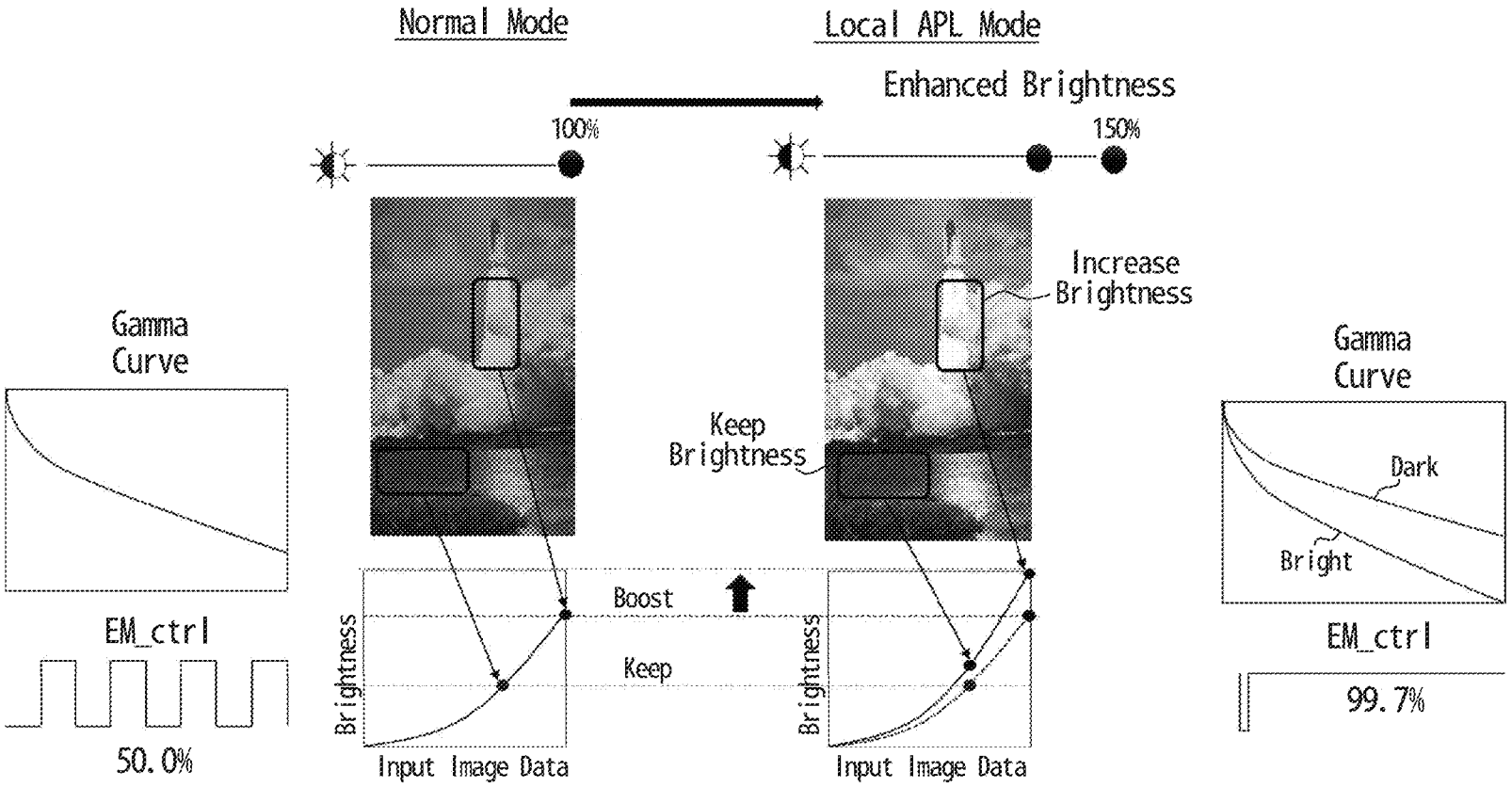
FIG. 13 illustrates an example operation of a display device, according to one or more embodiments.

FIG. 13 illustrates an example operation of the display device 100. In one or more embodiments, when the display device 100 is placed in a normal mode, the brightness enhancement gain $G_{DBV}$ is set to "1," and the analog operation of the signal supply circuitry 12 and the image processing are controlled based on the DBV. In the example illustrated in FIG. 12, the emission command value Emission* is set so that the duty ratio of the emission control signal EM_ctrl is set to 50%, and a gamma curve associated with the DBV is used in the image processing.

In one or more embodiments, when the display device 100 is placed in the local APL mode, the highest brightness enhancing DBV is calculated based on the highest local APL. Further, in an embodiment where the display image contains a bright portion as illustrated in FIG. 12, one or more local APLs calculated for the bright portion increase, and the highest local APL also increases. Accordingly, the highest brightness enhancing DBV is calculated to be larger than the original DBV. In the example illustrated in FIG. 12, the highest brightness enhancing DBV is 150% of the original DBV. In one or more embodiments, the analog operation of the signal supply circuitry 12 is controlled based on the highest brightness enhancing DBV. In the example illustrated in FIG. 12, the emission command value Emission* is set so that the duty ratio of the emission control signal EM_ctrl is set to 99.7%. This places the display device 100 into a state in which the display device 100 can brightly display the portion of the highest brightness of the display image. In one or more embodiments, image processing is performed to cancel the increase in the brightness caused by the analog operation control for a dark portion of the display image based on the local APLs calculated for the respective pixels 10. Accordingly, dark portion of the display image remains unchanged. The operation in the local APL mode illustrated in FIG. 12 may effectively improve the contrast.

While various embodiments have been specifically described herein, a person skilled in the art would appreciate that the technologies disclosed herein may be implemented with various modifications.

What is claimed is:

1. A display driver comprising:

signal supply circuitry configured to supply an emission control signal to a display panel, the emission control signal controlling a ratio of pixel circuits that emit light to pixel circuits of the display panel, wherein the signal supply circuitry uses a first set of control points and a second set of control points, wherein the first set of control points each comprises a first coordinate and a second coordinate for a gamma curve, wherein for at least a portion of the first set of control points, a previous first coordinate for the control point is multiplied by a coefficient determined from a brightness gain to generate the first coordinate while the second coordinate is the same as a previous second coordinate; and control circuitry configured to:

determine, based on input image data, local average picture levels (APLs) of respective partial areas in a display area of the display panel, determine a highest local APL from the local APLs, generate a highest brightness enhancing display brightness value (DBV) based, at least in part, on the highest local APL, generate the first set of control points based on the highest brightness enhancing DBV to increase a brightness of a bright portion of a display image, the display image corresponding to the input image data, and generate the second set of control points for a dark portion of the display image to cancel an increase in a brightness of the dark portion.

2. The display driver of claim 1, wherein generating the highest brightness enhancing DBV is further based on a DBV received from a device external to the display driver.

3. The display driver of claim 1, wherein each of the respective partial areas is associated with one or more pixels of the display panel.

4. The display driver of claim 1, wherein the signal supply circuitry comprises:

image processing circuitry configured to generate output voltage data based on the input image data; and data driver circuitry configured to drive the pixel circuits based on the output voltage data, and wherein generating the output voltage data comprises processing a first pixel of one or more pixels based on the local APL of the respective partial areas associated with the first pixel.

5. The display driver of claim 1, wherein the signal supply circuitry comprises:

image processing circuitry configured to apply an IR drop correction to the input image data to generate an output voltage data, wherein the IR drop correction compensates for a voltage drop over a power source line of the display panel; and data driver circuitry configured to drive the pixel circuits based on the output voltage data.

6. The display driver of claim 5, wherein the IR drop correction is based on a dispersion of luminance levels of pixels in the display panel.

7. The display driver of claim 5, wherein the IR drop correction is withheld based on a dispersion of luminance levels of pixels in the display panel.

8. The display driver of claim 1, wherein the control circuitry is configured to control a low-side power source voltage supplied to the display panel based on the input image data.

9. The display driver of claim 8, wherein controlling the low-side power source voltage comprises controlling the low-side power source voltage based on the local APLs.

10. The display driver of claim 8, wherein controlling the low-side power source voltage comprises controlling the low-side power source voltage based on the highest local APL.

11. The display driver of claim 1, wherein the signal supply circuitry comprises:

image processing circuitry configured to:

generate an output voltage data based on the input image data; and control a voltage range of drive voltages based on the input image data; and data driver circuitry configured to supply the drive voltages to the pixel circuits based on the output voltage data.

12. The display driver of claim 11, wherein controlling the voltage range of the drive voltages comprises controlling the voltage range based on the first set of control points and the second set of control points.

13. The display driver of claim 1, wherein the gamma curve specifies an output voltage data for each of a plurality of grayscale values of input image data.

14. The display driver of claim 13, wherein the first set of control points and the second set of control points scales, from a base set of control points, the gamma curve along an axis of the gamma curve corresponding to the plurality of grayscale values of the input image data.

15. The display driver of claim 1, wherein the coefficient determined from the brightness gain is calculated as:

$\alpha=1/G_brt^{1/\gamma}$, where $\alpha$ is the coefficient, G_brt is the brightness gain, and $\gamma$ is gamma value set to the display panel.

16. The display driver of claim 1, wherein the brightness gain is a ratio of a luminance level corresponding to the local APL associated with a selected pixel to a luminance level corresponding to the highest local APL.

17. A display device, comprising:

a display panel; and a display driver comprising:

signal supply circuitry configured to supply an emission control signal to the display panel, the emission control signal controlling a ratio of pixel circuits that emit light to pixel circuits of the display panel, wherein the signal supply circuitry uses a first set of control points and a second set of control points, wherein the first set of control points each comprises a first coordinate and a second coordinate for a gamma curve, wherein for at least a portion of the first set of control points, a previous first coordinate for the control point is multiplied by a coefficient determined from a brightness gain to generate the first coordinate while the second coordinate is the same as a previous second coordinate; and control circuitry configured to:

determine, based on input image data, local average picture levels (APLs) of respective partial areas in a display area of the display panel, determine a highest local APL from the local APLs, generate a highest brightness enhancing display brightness value (DBV) based, at least in part, on the highest local APL, generate the first set of control points based on the highest brightness enhancing DBV to increase a brightness of a bright portion of a display image, the display image corresponding to the input image data, and generate the second set of control points for a dark portion of the display image to cancel an increase in a brightness of the dark portion.

18. The display device of claim 17, wherein generating the highest brightness enhancing DBV is further based on a DBV received from device external to the display driver.

19. A method comprising:

determining, based on input image data, local average picture levels (APLs) of respective partial areas in a display area of a display panel;

determining a highest local APL from the local APLs;

generating a highest brightness enhancing display brightness value (DBV) based, at least in part, on the highest local APL;

generating a first set of control points based on the highest brightness enhancing DBV to increase a brightness of a bright portion of a display image, the display image corresponding to the input image data;

generating a second set of control points for a dark portion of the display image to cancel an increase in a brightness of the dark portion, wherein the first set of control points each comprises a first coordinate and a second coordinate for a gamma curve, wherein for at least a portion of the first set of control points, a previous first coordinate for the control point is multiplied by a coefficient determined from a brightness gain to generate the first coordinate while the second coordinate is the same as a previous second coordinate; and supplying, using the first set of control points and the second set of control points, an emission control signal to the display panel, the emission control signal controlling a ratio of pixel circuits that emit light to pixel circuits of the display panel.

* * * * *